US007527583B2

(12) United States Patent
Watanabe

(10) Patent No.: US 7,527,583 B2
(45) Date of Patent: May 5, 2009

(54) PAPER MACHINE PRESS ROLL WITH A CERAMIC COATING

(75) Inventor: Atsuo Watanabe, Hirakata (JP)

(73) Assignee: Yamauchi Corporation, Osaka (JP)

( * ) Notice: Subject to any disclaimer, the term of this patent is extended or adjusted under 35 U.S.C. 154(b) by 806 days.

(21) Appl. No.: 11/085,692

(22) Filed: Mar. 21, 2005

(65) Prior Publication Data

US 2005/0215403 A1 Sep. 29, 2005
US 2007/0037681 A9 Feb. 15, 2007

(30) Foreign Application Priority Data

Mar. 25, 2004 (JP) ..... 2004-088901

(51) Int. Cl.
*D21F 3/08* (2006.01)
*C23C 4/10* (2006.01)

(52) U.S. Cl. ..... 492/20; 492/26; 492/28; 492/59; 427/453

(58) Field of Classification Search ..... 492/20, 492/26, 28, 59; 29/895.32; 427/453
See application file for complete search history.

(56) References Cited

U.S. PATENT DOCUMENTS 5,609,553 A * 3/1997 Hyllberg ..... 492/53
6,461,687 B2 * 10/2002 Vestola et al. ..... 427/454
6,888,274 B2 * 5/2005 Woydt et al. ..... 310/81

FOREIGN PATENT DOCUMENTS

| | | |
|---|---|---|
| EP | 0-207-921 B2 | 8/1992 |
| JP | 05-0090704 | 7/1975 |
| JP | 6081292 | 3/1994 |
| JP | 7279086 | 10/1995 |
| JP | 8060596 | 3/1996 |
| JP | 08-232188 | 9/1996 |
| JP | 10219281 | 8/1998 |
| JP | 10219581 | 8/1998 |
| KR | 1999-008364 | 1/1999 |
| KR | 10-2006-7009588 | 4/2007 |

* cited by examiner

*Primary Examiner*—David P Bryant
*Assistant Examiner*—Sarang Afzali
(74) *Attorney, Agent, or Firm*—Ditthavong Mori & Steiner, P.C.

(57) ABSTRACT

A paper machine press roll comprises a core roll and a ceramics sprayed film formed on an outer periphery of the core roll, in which values of Rk and Vo which are characteristic evaluation parameters of a plateau-structure surface of the ceramics sprayed film are $Rk \leqq 8.0\ \mu m$ and $Vo \geqq 0.030\ mm^3/cm^2$.

$(Vo=(100-Mr2)\times Rvk/2000\ (mm^3/cm^2)$ where Rk, Mr2 and Rvk are a core level difference, a core load length ratio and a projecting valley depth, respectively which are defined in JIS B0671-2-2002 (ISO13565-2-1996).

4 Claims, 3 Drawing Sheets

PAPER MACHINE PRESS ROLL WITH A CERAMIC COATING

BACKGROUND OF THE INVENTION

1. Field of the Invention

The present invention relates to a paper machine press roll and more particularly, it relates to a press roll which is used in a press section of a paper machine to remove water from a wet paper web and to transfer smoothness to a surface of the wet paper web.

2. Description of the Background Art

As a pressing method of a wet paper web in a press section of a paper machine, a roll press and an extended nip press (ENP) are well known. The roll press is a system of removing water from the wet paper web while the wet paper web is held on a felt and passes between pressurized two revolving rolls, and the extended nip press is a system of removing water from the wet paper web while the wet paper web is held on a felt and passes between a belt pressurized by a pressure shoe having a large nip width and a revolving roll.

In either system, the revolving roll has a hard surface in view of a pressurizing effect and a smoothness-transfer effect. In the roll press, the revolving roll having the hard surface and a roll covered with a rubber or the like are combined to be used.

It is expected that the revolving roll having the hard surface has performance which transfers smoothness to a surface of the paper and can withstand high loading, high-speed revolving and long use. In order to answer the above expectation, conventionally a stone roll (granite roll) using natural granite has been used. According to the stone roll, since it can provide mirror surface finish in general, its smoothness-transfer effect to the paper is excellent, its surface is hard, and wear caused by a doctor blade which is provided for removing waste paper is small. In addition, according to the stone roll, since it has concave parts in the roll surface because of voids of crystal particles or cleavages of mica contained in the granite and these provide an appropriate water holding property, a paper peeling property of the wet paper web is preferable. Furthermore, since it has a property in which pitch and the like contained in pulp is not likely to be adhered even in long-term use, the paper is not likely to be cut at the time of press.

Although the stone roll has the above advantages, it has the following defects because it is a natural stone. First, the natural stone is not easily available because of depletion resources, so that it becomes very expensive and it takes long time until the stone is delivered. In addition, it is very difficult to quarry, deliver and process a large stone for the press roll which is becoming long and large. Furthermore, since the stone is a polycrystalline natural stone, there is variation in surface characteristics (such as surface asperity, surface hardness, a water holding property and the like) depending on manufactured rolls and even on the surface of one roll, there is variation in the surface characteristics, which is an essential problem.

As a substitute for the stone roll, there is disclosed a synthetic stone roll in which powder particles of granite, quartz sand or the like are mixed in a hard rubber or a hard resin in Japanese Unexamined Patent Publication No. 50-90704. However, according to the synthetic stone roll, its water holding property on the surface is not sufficient and the paper peeling property is not good basically. In addition, since an organic matter is used as a binder, pitch is likely to be adhered and since its surface hardness is low, the uniformity on the surface is damaged by the doctor blade. Thus, the paper is likely to be cut or wrinkle up in a short time, so that the synthetic stone roll is not suitable for a long operation.

As a press roll which can solve the above problems, there is proposed a ceramics sprayed roll in which ceramics is sprayed on a core roll. As a method for forming a ceramics film on the core roll, there is a water stabilized plasma spraying method, a gas plasma spraying method or the like. A paper machine press roll in which a ceramics film is formed on a core roll by the water stabilized plasma spraying method is disclosed in Europe Patent Publication No. EP0207921B, and a paper machine press roll in which a ceramics film is formed on a core roll by the gas plasma method is disclosed in Japanese Unexamined Patent Publication No. 8-232188, for example.

In the case of the water stabilized plasma spraying method, since a particle diameter of the ceramics powder used as a sprayed material in general is large, the sprayed film is not finely formed. Therefore, it has been thought that the paper machine press roll in which the ceramics film is formed by the water stabilized plasma sprayed method has a coarse roll surface and an inferior smoothness-transfer effect to the paper, and a doctor blade attached on the roll surface is excessively worn. Therefore, the water stabilized plasma spraying method dose not attract attention as the method of forming the ceramics film of the paper machine press roll.

Meanwhile, in the case of the gas plasma spraying method, since a particle diameter of ceramics powder to be used as a sprayed material is small, a sprayed film is finely formed. In this respect, the paper machine press roll in which the ceramics film is formed by the gas plasma spraying method prevails at present.

However, according to an examination by the inventor of the present invention, in the case of the press roll in which the ceramics film is formed by the gas plasma spraying method, since the sprayed film is fine, smoothness of the roll surface is preferable but adhesiveness between the roll surface and the wet paper web is high, so that the paper peeling property deteriorates. When the paper peeling property is low, a surface of the wet paper web is adhered to the roll surface as waste paper while the wet paper web passes through a press nip, so that paper quality deteriorates. Furthermore, when the paper peeling property is low, it is necessary to increase a drawing value (a degree of drawing force required to peel the wet paper web from the roll surface) provided between the press nip and the next step. If the drawing value is great, the paper is deformed by tensile force to peel the wet paper web from the roll surface. As a result, the paper quality is lowered. Furthermore, when the paper peeling property is low, the paper could be cut between the press roll and the next step, which could cause serious damage to a paper factory. Thus, the inferior paper peeling property could be a fatal defect for the press roll.

Conventionally, according to the ceramics film of the press roll, it has been thought that its surface roughness is preferably small in view of the smoothness-transfer effect to the paper and wear prevention of the doctor blade, but the surface roughness is preferably large in view of the paper peeling property. As an index for evaluating the surface roughness, arithmetic average roughness Ra defined in JIS B0601-2001 (ISO4287-1997) has been used. The arithmetic average roughness Ra is basically found by equivalently treating a height of a convex part and a depth of a concave part as absolute values and averaging them. However, according to an examination and study by the inventor of the present invention, the surface characteristics of the paper machine press roll comprising the ceramics sprayed film cannot be correctly evaluated only by the arithmetic surface roughness Ra.

In the paper machine press roll, only the convex part of the press roll affects the smoothness-transfer effect to the paper and the wear of the doctor blade, so that the smoothness-transfer effect to the paper and the wear prevention effect of the doctor blade can be enhanced by reducing the height of the convex part. Meanwhile, the concave part of the press roll affects the paper peeling property of the wet paper web, so that the water holding property and an air acquiring property at the concave part can be improved by increasing the depth or capacity of the concave part. As a result, the adhesiveness of the wet paper web can be lowered and the paper peeling property is improved. In the case the surface roughness of the press roll is evaluated with the arithmetic average roughness Ra like in the conventional example, when the value of Ra is reduced in order to enhance the smoothness-transfer effect to the paper and to prevent the wear of the doctor blade, the paper peeling property is lowered, but when the value of the Ra is increased in order to improve the paper peeling property of the wet paper web, the smoothness-transfer effect is lowered and the doctor blade is likely to be worn. Thus, even if the arithmetic average roughness Ra of the roll surface is set at any value, the smoothness-transfer effect to the paper is lowered and the doctor blade is worn in an early stage, or the paper peeling property is lowered, so that it is difficult to provide satisfactory performance in all of the above aspects.

SUMMARY OF THE INVENTION

The present invention was made in order to solve the above problems and it is an object of the present invention to provide a paper machine press roll comprising a ceramics sprayed film which provides excellent performance in all of a smoothness-transfer effect, a wear prevention effect of a doctor blade, and a paper peeling property.

It is another object of the present invention to provide a method of manufacturing a paper machine press roll comprising a ceramics sprayed film which provides excellent performance in all of a smoothness-transfer effect, a wear prevention effect of a doctor blade, and a paper peeling property.

According to surface texture of the press roll comprising the ceramics sprayed film, a height of a convex part and a depth of a concave part cannot be equivalently treated as absolute values and it should be considered that each is related to different performance. It is ideal that the convex part is low and the concave part is deep in the surface texture of the press roll comprising the ceramics sprayed film.

In view of the above respects, the inventor of the present invention focused on a characteristic evaluation parameter of a plateau-structure surface defined in JIS B0671-2-2002 (ISO1365-2-1996) as an index for evaluating the surface texture of the press roll. In addition, the standard in JIS B0671-2-2002 (ISO13565-2-1996) defines a filter processing method for a surface having a plateau part which is finely finished, and a deep valley part under the plateau part. Here, the "plateau part" is an irregular waveform part which is provided by removing a protruding part from a coarse outline curve by fine finishing and the "valley part" is an irregular waveform part existing under the plateau part.

Characteristic Evaluation Parameter of Plateau-Structure Surface

The characteristic evaluation parameters of the plateau-structure surface will be described with reference to FIGS. 1, 2 and 3. In addition, while Mr1, Mr2, Rpk, Rvk and Rk are defined in JIS B0671-2-2002 (ISO 13565-2-1996), Vo and K are not defined in JIS B0671 (ISO13565) but they are consumer standards used in general.

(The following is a reference from a manual of "surface texture and contour measuring instrument 'HANDYSURF E-35A' (Tokyo Seimitsu), P65, P66 and P67.)

'In this standard, a load curve is divided into an initial wear part, a substantial contact part and an oil retention part, and lubrication properties of them are evaluated. Mainly a plateau horning process face is an object and the following parameters are calculated from a load curve in FIG. 1.

(1) Core Load Length Ratio 1 (Initial Wear Load Ratio) Mr1 (Material Portion 1)

A width of 40% is set on the load curve in the direction of a "tp" value, a position in which inclination of least square linear line calculated from the data in the width becomes a minimum is found and a point "a" is set at the intersection of that line (equivalent line) with a limit line in which tp=0%.

A point at the intersection of a horizontal line "ac" from the point "a" with the load curve is set as "c" and the value "tp" at this point is set as Mr1, which shows a load length ratio after the initial wear.

(2) Core Load Length Ratio 2 (Oil Retention Load Ratio) Mr2 (Material Portion 2)

A width of 40% is set on the load curve in the direction of the "tp" value, a position in which inclination of least square linear line calculated from the data in the width becomes a minimum is found and a point "b" is set at the intersection of that line (equivalent line) with a limit line in which tp=100%.

A point at the intersection of a horizontal line "bd" from the point "b" with the load curve is set as "d" and the value "tp" at this point is set as Mr2, which shows a load length ratio after long-term wear.

(3) Projecting Peak Height Rpk (Reduced Peak Height)

A height in a right triangle having the line "ac" as one side on the limit line in which tp=0% is set as Rpk, which right triangle has the same area of a part surrounded by the 0% limit value, the side "ac" and the load curve. This shows an initial wear height.

(4) Projecting Valley Depth Rvk (Reduced Valley Depth)

A height in a right triangle having the line "bd" as one side on the 100% limit line is set as Rvk, which right triangle has the same area of a part surrounded by the 100% limit value, the side "bd" and the load curve. This shows an oil retention valley depth.

(5) Core Level Difference Rk (Core Roughness Depth)

A difference in height between the above "c" and "d" is set as Rk. This shows a height which is worn until the surface cannot be used because of the long-term wear.

(6) Oil Retention Volume Vo

This shows volume of oil of an oil retention depth per surface area of 1 $cm^2$.

$$Vo=(100-Mr2)\times Rvk/2000\ (mm^3/cm^2)$$

In the above equation, the unit of Mr2 is % and the unit of Rvk is μm.

(7) Oil Retention Depth Ratio K (Reduced Valley Depth Ratio)

This shows a ratio of the oil retention depth to effective load roughness. As this value becomes greater a lubrication property becomes better.'

As described above, JIS B0671-2 (ISO13565-2) is the standard which is set to evaluate the lubrication property. This standard is used mainly when a slide property and oil retention volume in a cylinder inner surface of an engine are evaluated. However, when this standard is used for the press roll comprising the ceramics sprayed film, the smoothness-transfer effect to the paper, the wear of the doctor blade and the paper peeling property of the wet paper web can be appropriately evaluated.

The Invention According to Claims 1 and 2

A paper machine press roll according to the present invention comprises a core roll, and a ceramics sprayed film formed on an outer periphery of the core roll, and it is characterized in that values of Rk and Vo which are characteristic evaluation parameters of a plateau-structure surface of the ceramics sprayed film are such that Rk≦8.0 μm and Vo≧0.030 $mm^3/cm^2$. (Vo=(100−Mr2)×Rvk/2000 ($mm^3/cm^2$)).

Here, Rk, Mr2 and Rvk are a core level difference, a core load length ratio and a projecting valley depth, respectively which are defined in JIS B0671-2-2002 (ISO13565-2-1996).

Since the value of Rk relates to a height of the convex part in the ceramics sprayed film, this is a factor which affects the smoothness-transfer effect and the wearability of the doctor blade. When this value is more than 4.0 μm, the smoothness-transfer effect to the paper deteriorates and the wear volume of the doctor blade is increased. Thus, the value of Rk has to be not more than 8.0 μm. Since the value of Rk is preferable as it becomes small, its lower limit value is not particularly set. However, it is usually not less than 0.1 μm.

Since the value of Vo relates to volume of the concave part in the ceramics sprayed film, it is a factor which affects the paper peeling property. More specifically, as the value of Vo becomes great, the water holding property and the air acquiring property on the surface of the ceramics sprayed film are improved. That is, when the value of Vo is great, water and air are contained in the space between the concave part of the press roll surface and the wet paper web just before the wet paper web which passed through the press nip peels off the press roll. Therefore, when the wet paper web peels off the press roll, air from the outside can easily enter between the press roll and the wet paper web, so that the paper peeling property is improved. In order to provide a preferable paper peeling property as the paper machine press roll, the value of Vo has to be not less than 0.030 $mm^3/cm^2$. Although an upper limit value of Vo is not particularly set, it may be not more than 1.000 $mm^3/cm^2$.

More preferable values of Rk and Vo as the paper machine press roll are as follows.

$$Rk \leqq 5.0\ \mu m$$

$$Vo \geqq -0.034\ mm^3/cm^2$$

The Invention According to Claim 3

More preferably, a value of a projecting peak height Rpk which is a characteristic evaluation parameter of the plateau-structure surface defined in JIS B0671-2-2002 (ISO13565-2-1996) satisfies the following range.

$$Rpk \leqq 1.5\ \mu m.$$

Since Rpk relates to the height of a projecting peak in the ceramics sprayed film, it is a factor which affects the smoothness-transfer effect and the wearability of the doctor blade similar to Rk. In order to provide a preferable smoothness-transfer effect as the paper machine press roll and to reduce the wear of the doctor blade, it is preferable that the value of Rpk is not more than 1.5 μm. More preferably, it is not more than 1.0 μm and further more preferably, it is not more than 0.7 μm. A lower limit value of Rpk is not particularly set, it may be not less than 0 μm.

Invention According to Claim 4

Preferably, a value of the projecting valley depth Rvk which is a characteristic evaluation parameter of the plateau-structure surface defined in JIS B0671-2-2002 (ISO13565-2-1996) satisfies the following range.

$$Rvk \geqq 3.0\ \mu m.$$

Since the value of Rvk relates to a projecting valley depth in the ceramics sprayed film, it is a factor which affects the paper peeling property similar to Vo. In order to increase the water holding property and the air acquiring property on the ceramics sprayed film surface so as to be appropriate as the paper machine press roll, the value of Rvk is preferably not less than 3.0 μm. More preferably, it is not less than 4.0 μm and further more preferably, it is not less than 5.0 μm. An upper limit value of Rvk is not particularly determined, it may be not more than 100 μm.

Invention According to Claims 5 to 7

According to a method of manufacturing a paper machine press roll of the present invention, a ceramics sprayed film is formed by spraying ceramics powder on a core roll. It is characterized in that the ceramics powder prepared for a sprayed material contains fine particles whose diameter is less than 55 μm and coarse particles whose diameter is not less than 55 μm and less than 149 μm. The whole ceramics powder contains 50% to 98% by weight of the fine particles and 50% to 2% by weight of the coarse particles. More preferably, the ceramics powder contains fine particles whose diameter is less than 55 μm and coarse particles whose diameter is not less than 74 μm and less than 149 μm and the content of the fine particles is within a range of 50% to 95% and the content of the coarse particles is within a range of 45% to 2%. More preferably, after the ceramics sprayed film is formed, a surface of the ceramics sprayed film is ground so that a value of the core level difference Rk which is a characteristic evaluation parameter of a plateau-structure surface defined in JIS B0671-2-2002 (ISO13565-2-1996) becomes Rk≦4.0 μm. The surface grinding is usually performed such that coarse grinding is performed and then finish grinding is performed. When the finish grinding is performed, a grinding stone or a grinding film may be used. A grinding material used in the finish grinding is preferably the grinding stone of #120 to #1000 or the grinding film comprising grinding particles of 15 μm to 100 μm. Preferably, a spraying method is the water stabilized plasma spraying method.

According to the above method, the ceramics sprayed film having characteristics described in claims 1 to 4 can be easily provided.

In the case of the gas plasma spraying method, since its melt heat quantity is small, it is difficult to spray the coarse particles in general. However, according to the ceramics sprayed film described in claims 1 to 4, it can be manufactured by forming a ceramics film by the gas plasma spraying method, performing an extreme surface roughning process for the ceramics film to provide a sufficient water holding property and an air acquiring property, and then performing surface grinding process so that the film has a predetermined smooth surface while relatively deep valleys are left in the surface.

However, a more effective and reliable manufacturing method is such that ceramics powder containing the fine particles and coarse particles appropriately is sprayed by the water stabilized plasma spraying method. The benefit of the water stabilized plasma spraying method is that its melt heat quantity is large and the ceramics powder having large particle diameter can be sprayed.

When the ceramics powder comprises only the coarse particles as the sprayed material, or it contains large amount of coarse particles, although the water holding property and the air acquiring property are preferable, the smoothness-transfer effect is lowered. In addition, the doctor blade is largely worn.

Meanwhile, when the ceramics powder comprises only the fine particles as the sprayed material, or it contains large amount of fine particles, although the smoothness-transfer effect is excellent and the doctor blade is less worn, the water holding property and the air acquiring property are degraded and the paper peeling property is also degraded. Especially, the inferior paper peeling property could be a serious defect as the press roll.

Therefore, in order to provide the ceramics sprayed film which provides the preferable paper peeling property, has the superior smoothness-transfer effect and reduces the wear of the doctor blade, the water stabilized plasma spraying method which uses the ceramics powder appropriately containing predetermined coarse particles and fine particles as the sprayed material is desirable.

Especially, when the coarse particles are contained by a predetermined ratio, appropriate concave parts are formed around the coarse particles and missing parts of the coarse particles by the grinding process, so that the values of Vo and Rvk become relatively great values. It is thought that the concave part contributes to the preferable water and air holding properties and to the preferable paper peeling property of the wet paper web when the paper machine press roll is used. In addition, when the fine particles are contained by a predetermined ratio, the height of the convex part in the ceramics sprayed film, that it, the values of Rk and Rpk can be relatively small. The low convex part contributes to the preferable smoothness-transfer effect to the paper and the wear prevention of the doctor blade. When a content ratio of the coarse particles is increased, the value of Vo or Rvk is increased. Meanwhile, it is thought that when a content ratio of the fine particles is increased, and the content ratio of the coarse particles is decreased, the value of Rk or Rpk is reduced in general.

Invention According to Claim 8

A press method for a wet paper web according to the present invention is the method of removing water from the wet paper web and transferring smoothness to a surface of the paper with a press roll in a press section of the paper machine. It is characterized in that the press roll comprises a core roll and a ceramics sprayed film formed on an outer periphery of the core roll, and values of Rk and Vo which are characteristic evaluation parameters of a plateau-structure surface of the ceramics sprayed film are $$Rk \leqq 8.0\ \mu m \text{ and}$$

$$Vo \geqq 0.030\ mm^3/cm^2.$$

Invention According to Claim 9

According to a method of grinding a surface of a paper machine press roll of the present invention, a surface grinding process is performed on the paper machine press roll comprising a core roll and a ceramics sprayed film formed on an outer periphery of the core roll. It is characterized in that values of Rk and Vo which are characteristic evaluation parameters of a plateau-structure surface of the ceramics sprayed film are ground to be $$Rk \leqq 8.0\ \mu m \text{ and}$$

$$Vo \geqq 0.030\ mm^3/cm^2.$$

DESCRIPTION OF THE PREFERRED WORKING EXAMPLES

The inventor of the present invention measured a surface roughness curve on the ceramics sprayed film formed by the water stabilized plasma spraying method and a surface roughness curve on the ceramics sprayed film formed by the gas plasma spraying method.

A sprayed material in the water stabilized plasma spraying method was ceramics powder which appropriately contains fine particles whose diameter is less than 55 μm and coarse particles whose diameter is not less than 74 μm and less than 149 μm. A content of the fine particles was about 82% by weight and a content of the coarse particles was about 3% by weight.

A sprayed material in the gas plasma spraying method was ceramics powder comprising only particles whose diameter was less than 55 μm.

Figure 1:
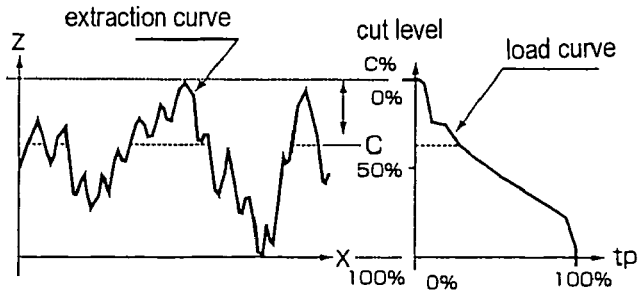
FIG. 1 is a view showing a load curve.
Figure 2:
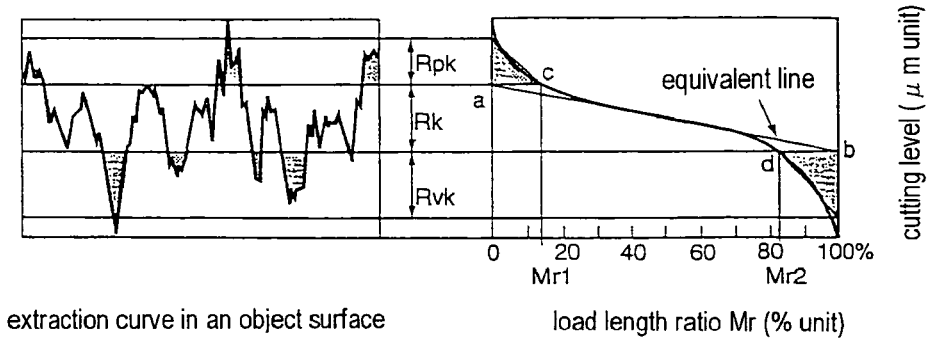
FIG. 2 is a view showing an extraction curve and a load length ratio in an object surface.
Figure 3:
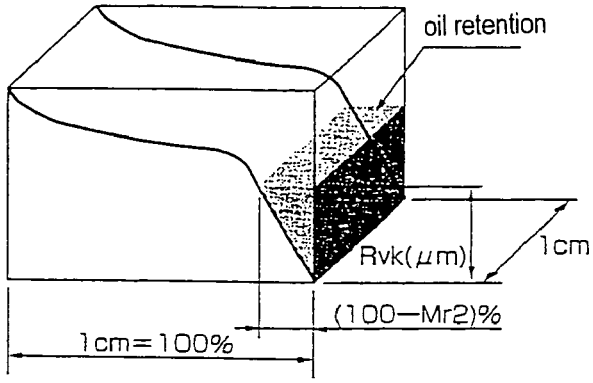
FIG. 3 is a view showing oil retention volume.
Figure 4:
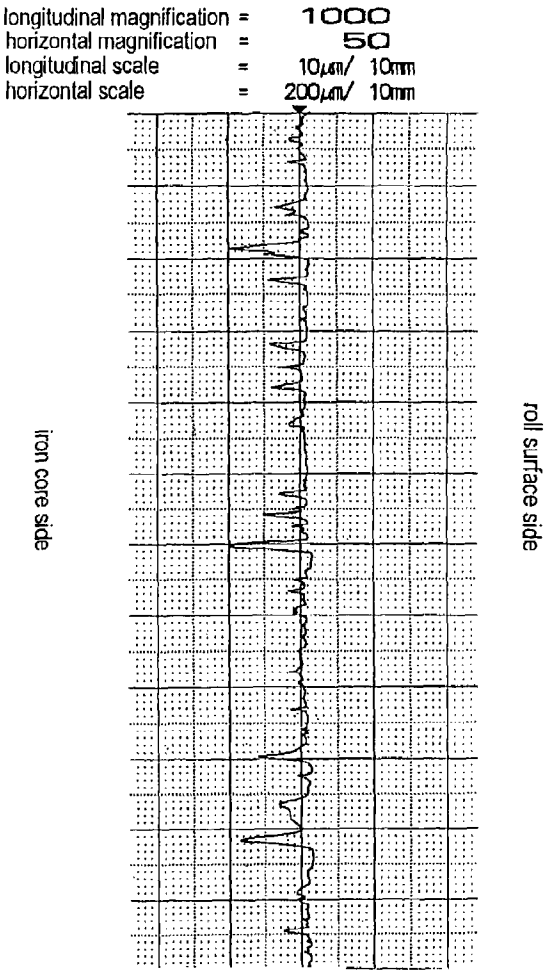
FIG. 4 is a view showing a surface roughness curve on a ceramics sprayed film formed by a water stabilized plasma spraying method.

After the films were formed by the water stabilized plasma spraying method and the gas plasma spraying method, respective predetermined surface grinding processes are performed on the films and their surface roughness curves were measured. The surface roughness curves were measured by the measuring instrument HANDYSURF E-35A produced by Tokyo Seimitsu. FIG. 4 is a surface roughness curve of the ceramics sprayed film formed by the water stabilized plasma spraying method, and FIG. 5 is a surface roughness curve of the ceramics sprayed film formed by the gas plasma spraying method.

As can be clear from FIG. 4, in the case of the ceramics sprayed film formed by the water stabilized plasma spraying method, a peak projecting from the surface is low and a valley projecting in the depth direction is deep. An outline curve of the peak projecting from the surface and an outline curve of the valley projecting in the depth direction are clearly asymmetric. In addition, curves showing deep valleys appear at relatively large intervals. It is thought that the deep valley appears around the large particle or the missing part of the coarse particle by the grinding process.

Figure 5:
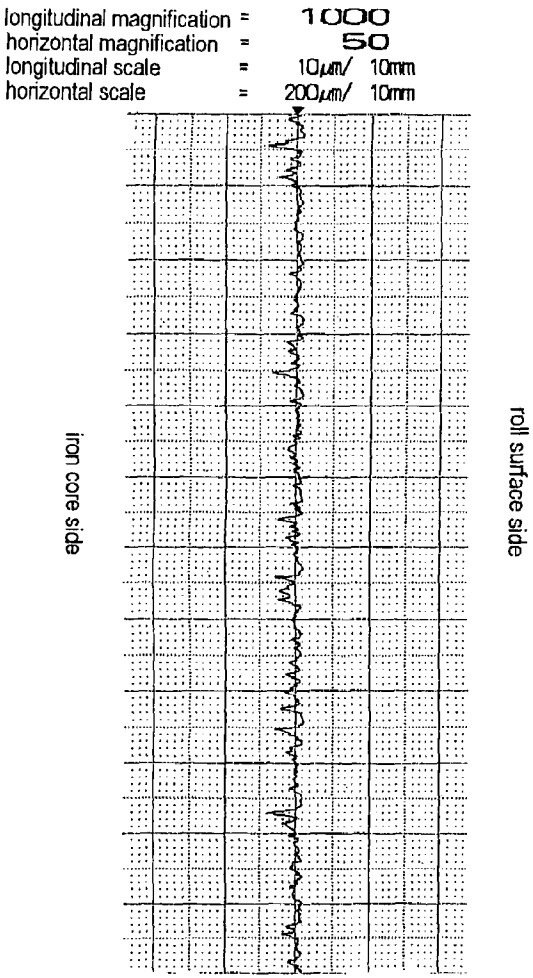
FIG. 5 is a view showing a surface roughness curve on a ceramics sprayed film formed by a gas plasma spraying method.

As can be clear from FIG. 5, in the case of the ceramics sprayed film formed by the gas plasma spraying method, a height of a peak projecting from the surface is about the same length as a depth of a valley projecting in the depth direction, and an outline curve of the peak and an outline curve of the valley are almost symmetric.

Figure 6:
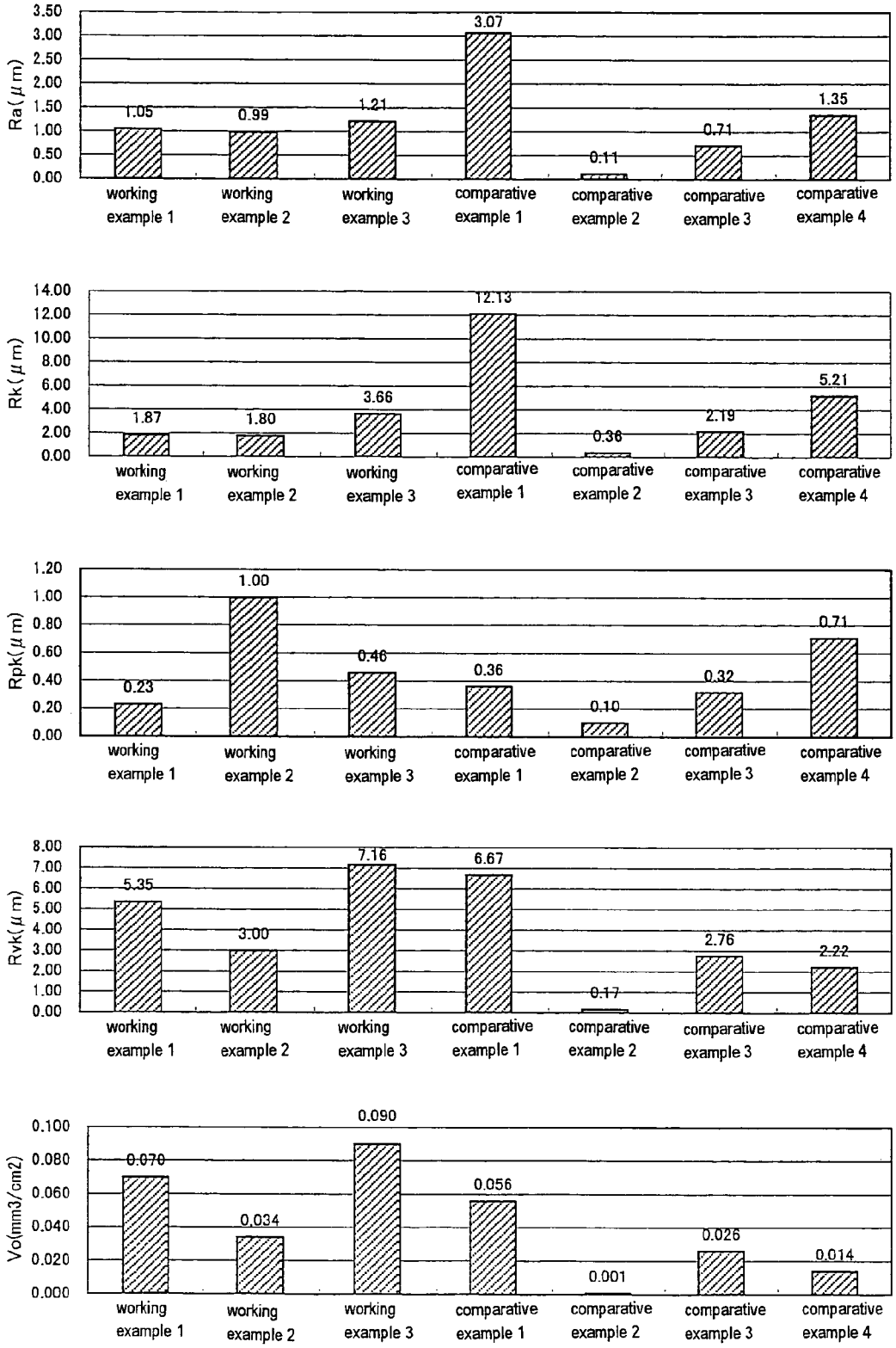
FIG. 6 is views for comparing various kinds of parameters regarding surface roughness of various kinds of samples of paper machine press rolls.

Parameters regarding the surface roughness in the various paper machine press rolls were measured. As a measuring instrument, the HNDYSURF E-35A produced by Tokyo Seimitsu was used and a surface texture was measured at 28 positions in each roll and their average value was calculated. FIG. 6 shows the result. Each parameter shows the following value.

Ra: arithmetic average roughness (μm) defined in JIS B0601-2001 (ISO4287-1997)

Rk: a core level difference (μm) defined in JIS B0671-2-2002 (ISO 13565-2-1996)

Rpk: a projecting peak height (μm) defined in JIS B0671-2-2002 (ISO 13565-2-1996)

Rvk: a projecting valley depth (μm) defined in JIS B0671-2-2002 (ISO 13565-2-1996)

Vo: $Vo=(100-Mr2)\times Rvk/2000$ ($mm^3/cm^2$)

Here, Mr2 is a core load length ratio which is defined in JIS B0671-2-2002 (ISO13565-2-1996).

In addition, samples provided for the measurement are as follows.

WORKING EXAMPLE 1

According to a working example of the present invention, a film was formed of ceramics powder containing fine particles and coarse particles appropriately as a sprayed material by the water stabilized plasma spraying method and its surface was ground. The ceramics powder contained 82% by weight of fine particles whose diameter was less than 55 μm and 5% by weight of coarse particles whose diameter was not less than 74 μm and less than 149 μm. According to the surface grinding, the surface was roughly ground with a diamond stone of #80 and then it was ground with a diamond stone of #200. Furthermore, finish grinding was performed with a grinding film comprising diamond particles of 40 μm.

WORKING EXAMPLE 2

According to a working example of the present invention, a film was formed of ceramics powder containing fine particles and coarse particles appropriately as a sprayed material by the water stabilized plasma spraying method and its surface was ground. The ceramics powder contained 90% by weight of fine particles whose diameter was less than 55 μm and 3% by weight of coarse particles whose diameter was not less than 74 μm and less than 149 μm. According to the surface grinding, the surface was roughly ground with the diamond stone of #80 and then the finish grinding was performed with a diamond stone of #400.

WORKING EXAMPLE 3

According to a working example of the present invention, a film was formed of ceramics powder containing fine particles and coarse particles appropriately as a sprayed material by the water stabilized plasma spraying method and its surface was ground. The ceramics powder contained 82% by weight of fine particles whose diameter was less than 55 μm and 5% by weight of coarse particles whose diameter was not less than 74 μm and less than 149 μm. According to the surface grinding, the surface was roughly ground with the diamond stone of #80 and then it was ground with the diamond stone of #200. Furthermore, the finish grinding was performed with a grinding film comprising silicon carbide particles of 40 μm.

COMPARATIVE EXAMPLE 1

A film was formed of ceramics powder containing only coarse particles whose diameter was not less than 55 μm and less than 149 μm as a sprayed material by the water stabilized plasma spraying method and its surface was ground. According to the surface grinding, the surface was roughly ground with the diamond stone of #80 and the finish grinding was performed with the diamond stone of #200.

COMPARATIVE EXAMPLE 2

It is a resin roll.

COMPARATIVE EXAMPLE 3

It is a paper machine press roll which has been used conventionally, which was formed of ceramics powder comprising fine particles as a sprayed material by a gas plasma spraying method. Then, the surface grinding was performed.

COMPARATIVE EXAMPLE 4

It is a paper machine press roll which has been used conventionally, which was formed of the ceramics powder comprising the fine particles as a sprayed material by the gas plasma spraying method. Then, surface roughning process was performed and the surface grinding was performed.

Evaluations of the above examples were as follows.

According to the working examples 1 to 3, the paper peeling property of the wet paper web was satisfactory, the smoothness-transfer effect to the paper was great and the wear of the doctor blade was small. The peeling property in the working examples 1 and 3 especially was extremely satisfactory.

According to the comparative example 1, although the paper peeling property was satisfactory, the smoothness-transfer effect to the paper was inferior and the doctor blade was seriously worn.

According to the comparative example 2, the paper peeling property was very bad and the wet paper web was completely adhered to the roll surface.

According to the comparative example 3, although the smoothness-transfer effect to the paper was satisfactory and the wear of the doctor blade was small, the paper peeling property was inferior.

According to the comparative example 4, although the surface roughning process was performed, the paper peeling property was not improved, the smoothness-transfer effect is inferior and the wear of the doctor blade was serious.

Although the embodiment of the present invention was described with reference to the drawings, the present invention is not limited to the illustrated embodiment. Various kinds of modifications and variations can be made to the illustrated embodiment within the same or equivalent scope of the present invention.

Since the paper machine press roll comprising the ceramics sprayed film according to the present invention provides superior performance both in paper peeling property and surface smoothness, it can be advantageously employed in a paper manufacturing field.

What is claimed is:

1. A paper machine press roll comprising:

core roll; and ceramics sprayed film formed on an outer periphery of the core roll, wherein values of Rk and Vo which are characteristic evaluation parameters of a plateau-structure surface of said ceramics sprayed film are $Rk \leqq 8.0$ μm and $Vo \geqq 0.030$ $mm^3/cm^2$, wherein Vo=(100=Mr2)×Rvk/2000($mm^3/cm^2$) where Rk, Mr2 and Rvk are a core level difference, a core load length ratio and a projecting valley depth, respectively which are defined in JIS B0671-2-2002 (ISO13565-2-1996).

2. The paper machine press roll according to claim 1, wherein values of said Rk and Vo are $Rk \leqq 5.0\ \mu m$ and $Vo \geqq 0.034\ mm^3/cm^2$.

3. The paper machine press roll according to claim 1, wherein a value of a projecting peak height Rpk which is a characteristic evaluation parameter of the plateau-structure surface defined in JIS B0671-2-2002 (ISO 13565-2-1996) is $Rpk \leqq 1.5\ \mu m$.

4. The paper machine press roll according to claim 1, wherein a value of the projecting valley depth Rvk which is a characteristic evaluation parameter of the plateau-structure surface defined in JIS B0671-2-2002 (ISO 13565-2-1996) is $Rpk \geqq 3.0\ \mu m$.

* * * * *